United States Patent [19]

Deaton

[11] Patent Number: 4,688,357

[45] Date of Patent: Aug. 25, 1987

[54] MULTI-PURPOSE STADIUM SYSTEM

[76] Inventor: Charles U. Deaton, 24501 Ski Hill Dr., Golden, Colo. 80401

[21] Appl. No.: 852,649

[22] Filed: Apr. 16, 1986

[51] Int. Cl.[4] ..... E04H 3/12

[52] U.S. Cl. ..... 52/9; 52/745

[58] Field of Search ..... 52/6–10, 52/126.5, 126.6, 745, 8, 9; 428/17

[56] References Cited

U.S. PATENT DOCUMENTS 1,433,547 10/1922 Hadden .

3,002,234 10/1961 Waterbury ..... 52/9

3,975,869 8/1976 Bouton .

4,085,557 4/1978 Tharp ..... 52/126.6

4,162,594 7/1979 Mackintosh .

4,191,496 3/1980 Becker ..... 52/126.5

*Primary Examiner*—James L. Ridgill, Jr.

*Attorney, Agent, or Firm*—Klaas & Law

[57] ABSTRACT

A multi-purpose stadium system having a plurality of separate sections of stands with front portions of the sections of stands being provided with seating means and wherein the sections of stands are relatively movable so as to change the shape of the surface area viewable from the seating means and to change the seating capacity of the stadium.

27 Claims, 11 Drawing Figures

MULTI-PURPOSE STADIUM SYSTEM

FIELD OF THE INVENTION

This invention relates generally to a stadium which is used for sporting, social and civic events and for any other gathering for a relatively large number of spectators to observe a surface area and more particularly to a multipurpose stadium system wherein entire sections of stands may be moved so as to change the shape and seating capacities of the stadium.

BACKGROUND OF THE INVENTION

There have been several stadiums constructed with the purpose of moving sections of stands or portions thereof so that a variety of activities may be conducted therein. The two most publicized activites for stadiums in the United States are football and baseball. At the present time, owners, managers and players in these sports feel that stadiums that can be converted to accommodate each sport do not work well. They feel that if it is good for baseball, it is not good for football and vice versa. This is due to many apparently irreconcilable differences such as the size of the fields, the shape of the fields, the differences in the playing surfaces and particularly in seating. Football has fewer games so that football stadiums are planned for larger per game attendance. Baseball has far more games so that baseball stadiums are planned for smaller attendance. Another major problem is that both football and baseball spectators want to be as close as possible to the playing field. In addition to the foregoing, aesthetics must be considered. Most spectators want a football stadium to look like a football stadium and a baseball stadium to look like a baseball stadium. Convertible stadiums now in use look like a make-shift compromise.

In Hadden, U.S. Pat. No. 1,433,547, there is disclosed a system for moving sections of stands about a plurality of a pivot axes so as to convert the grandstands from a shape for a football field to a shape for a baseball field. Hadden makes no attempt to solve the seating problem. Also, the playing surface for the baseball field must be located a substantial distance from the stands 10 and 11. Bouton, U.S. Pat. No. 3,975,869, provides a stadium having movable sections so that it may be converted to a variety of playing surfaces. However, as noted in FIGS. 2 and 3, Bouton accommodates substantially fewer spectators for football as compared to baseball. Mackintosh, U.S. Pat. No. 4,162,594, discloses portable grandstand seating sections but these sections have only limited seating capacity.

BRIEF DESCRIPTION OF THE INVENTION

This invention provides a system for a multi-purpose stadium wherein entire sections of stands are each separately movable so as to change the shape and seating capacities of the stadium as desired. In one embodiment of the invention, a plurality of sections of stands are arranged relative to each other so as to have the shape of a football stadium capable of seating about seventy thousand spectators. The sections of stands may then be readily moved relative to each other to provide an arrangement to have the shape of a baseball stadium capable of seating about fifty thousand spectators.

The above embodiment of the invention comprises a permanent, fixed supporting base having a generally horizontal surface for supporting the sections of stands and the playing surface for the activity involved. The supporting base has a predetermined perimeter and is formed from a suitable material such as reinforced concrete. A first section of stands having a front portion which is provided with seating means for spectators, a back portion and two side portions is fixedly mounted on the supporting surface with the bottom of the back surface thereof adjacent to a portion of the periphery of the supporting base. When the stadium is to be used for football, a second section, shaped similarly to the first section is located on the generally horizontal surface of the supporting base opposite to the first section. The first and second sections of stands each have a substantially straight portion approximately equal to the length of the playing surface of the football field and each have slightly curved end portions. A third section and a fourth section of stands are located between associated end portions of the first and second sections of stands. The seating means in the front portions of the four sections of stands face a first shaped surface area, which is a football field. When it is desired to convert the sections of stands to a baseball stadium, the fourth section of stands is moved over the generally horizontal surface to a storage area. The second section of stands is moved over the generally horizontal surface until one of its side portions on the end portion thereof is adjacent to and substantially mating with a side portion on the end portion of the first section of stands. The third section of stands is moved over the generally horizontal surface and rotated so that the back portion thereof is facing the seating means in the front portions of the first and second sections of stands. The seating means in the front portions of the first and second sections of stands face a second shaped surface area, which is a baseball field. In the arrangements described above, the seating means for viewing he football field will accommodate about seventy thousand spectators while the seating means for viewing the baseball field will accommodate about fifty thousand spectators. Whenever larger crowds are expected for a particular ball game, the third section of stands may be rotated so that the front section and seating means thereof will face the second surface area, which is the baseball field. The seating means in the third section will accommodate about ten thousand spectators.

Other modifications of the invention using two, three and four sections of stands are discussed below. In each of the modifications, the section of stands are arranged to define the conventional shape of a stadium for that sport with the seating means thereof as close as possible to the playing field.

It is an object of this invention to provide a multipurpose stadium using a plurality of sections of stands which are positioned relative to each other so as to define differently shaped surface areas and differently sized seating capacities.

It is another object of this invention to provide a system for providing a desired surface contour over differently shaped surface areas.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE DRAWING

Figure 1:
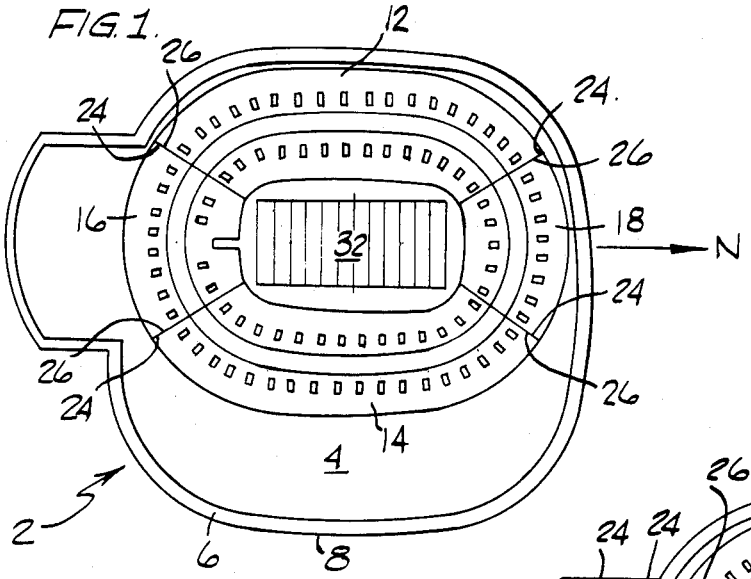
FIGS. 1–4 are top plan views of schematic illustrations of one modification of the invention and illustrating the sections of stands in different locations.

In FIG. 1, there is illustrated one modification of the invention for use as a stadium for football. A permanent, fixed, rigid supporting base 2, formed from reinforced concrete of a sufficient thickness, is provided with a generally horizontal surface 4. A wall 6 extends upwardly from adjacent the perimeter 8 of the supporting base 2 and is of conventional structure such as reinforced concrete. If desired, means (not shown) may be provided on the upper surface 10 (FIG. 6) of the wall 6 so that a dome can be placed thereon. If no dome is to be used, the wall 6 can be omitted.

A first section 12 of stands is mounted on the supporting base 2 at a fixed location. This first section 12 of stands is provided with the conventional, permanent facilities (not shown) normally associated with a stadium, such as offices, dressing rooms, rest rooms and concessions. In the modification of FIGS. 1–4, there are a second 14 section of stands, a third section 16 of stands and a fourth section 18 of stands. In FIG. 5, there is illustrated the general nature of each of the sections 12, 14, 16 and 18 of stands. Each section of stands has a front portion 20, a back portion 22 and side portions 24 and 26. Each front portion 20 is provided with conventional seating means 28 for spectators.

The sections 14, 16 and 18 of stands are mounted to be movable and rotatable over the generally horizontal surface 4 of the supporting base 2. Conventional means are used to move and rotate the sections 14, 16 and 18 of stands. One such means, that may be used, comprises a rubber shoe 30 that can be inflated with water to lift the section slightly off the generally horizontal surface 4. The rubber shoe 30 is designed to leak and spew a film of water to break the friction between the shoe 30 and the generally horizontal surface 4 so that the section can be moved by riding on this film of water. Such a system is used to move the east stands at Mile High Stadium in Denver, Colo. The sections 12, 14, 16 and 18 of stands are separate from each other but may be provided with joining means when a side portion 24 of one section is located adjacent to a side portion 26 of another section. The movable sections of stands are also provided with necessary facilities such as concession areas and restrooms.

As illustated in FIG. 1, the section 12, 14, 16 and 18 of stands have been positioned relative to each other so as to form an enclosure around the football field 32. As desirable for a football stadium the seating means 28 of the sections 12, 14, 16 and 18 of stands are as close as possible to the football field 32. In this embodiment, the sections 12 and 14 are provided with seating means 28 so that each section 12 or 14 may accommodate about twenty-five thousand spectators. The sections 16 and 18 of stands are provided with seating means 28 so that each section 16 or 18 may accommodate about ten thousand spectators. Therefore, when the sections 12, 14, 16 and 18 are arranged for use as a football stadium, they have a seating capacity for about seventy thousand spectators.

Figure 2:
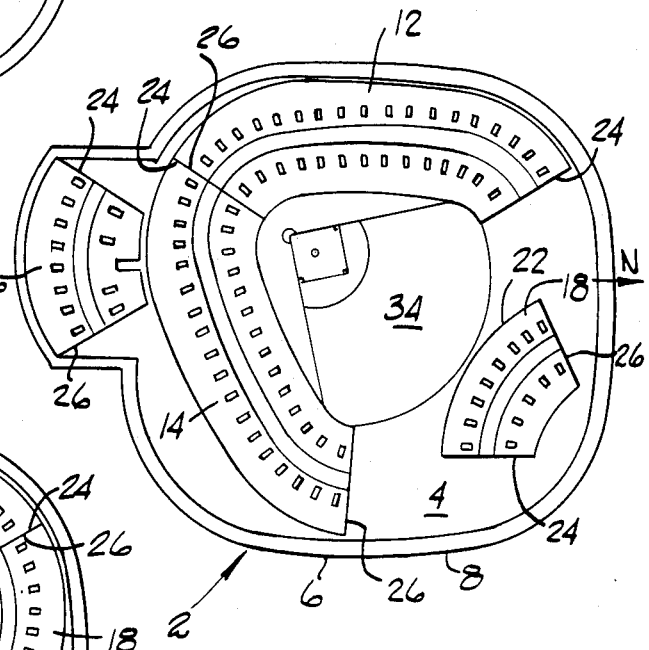

In the arrangement illustrated in FIG. 2, the sections 12, 14, 16 and 18 of stands have been positioned relative to each other to provide desired seating for a baseball field 34. The section 16 of stands is moved away from its location in FIG. 1 to a storage area on the generally horizontal surface 4. The section 14 of stands has been moved over the generally horizontal surface 4 and rotated slightly so that its side portion 24 is adjacent to the side portion 26 of the section 12 of stands. In the arrangement illustrated in FIG. 2, the entire section 16 of stands is not viewable by the spectators in the seating means 28 of the sections 12 and 14 of stands. The section 18 of stands has been moved over the generally horizontal surface 4 and rotated so that only the back portion 22 thereof is viewable from the seating means 28 of the sections 12 and 14 of stands. The back portion 22 of the section 18 of stands may be provided with conventional structures (not shown) to provide information to the spectators in the seating means 28 of the sections 12 and 14 of stands. The back of the section 18 of stands including the portion under the seating means 28 may also provide functional and aesthetic backgrounds such as waterfalls, walkways, special lighting effects and other attractive objects. As stated above, each of the sections 12 and 14 are provided with seating means 28 to accommodate about twenty-five thousand spectators. Therefore, when the sections 12, 14, 16 and 18 are arranged as illustrated in FIG. 2, the seating capacity can accommodate about fifty thousand spectators.

Figure 3:
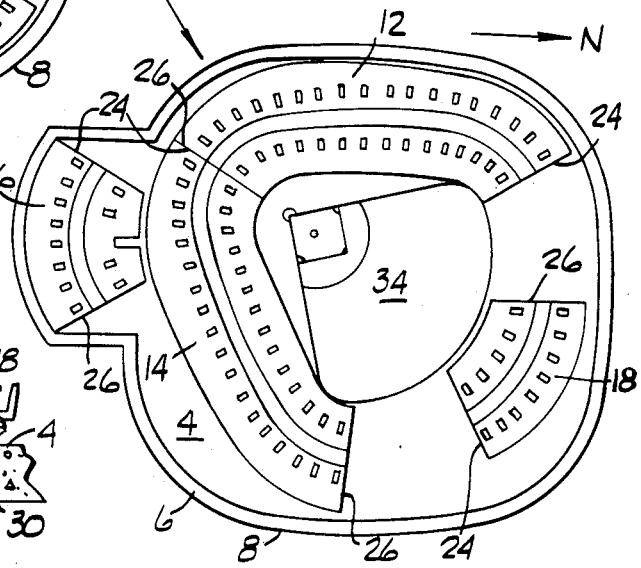

The arrangement illustrated in FIG. 3 is similar to that in FIG. 2 except that the section 18 of stands has been rotated so that the seating means 28 thereof are facing the baseball field 34. In FIGS. 2 and 3, it is noted that the seating means 28 in the sections 12 and 14 of stands are located in the desired position for viewing a baseball game. Since, as stated above, the section 18 of stands is provided with seating means 28 to accommodate about ten thousand spectators, the seating capacity for observing the baseball field 34 in FIG. 3 is about sixty thousand spectators. If desired, the sections 12 and 14 can be smaller so as to have a seating capacity each of about twenty thousand spectators and the sections 16 and 18 can be larger so as to have a seating capacity each of about fifteen thousand spectators. It is therefore within the scope of this invention to design sections 12, 14, 16 and 18 to have substantially any desired seating capacity.

Figure 4:
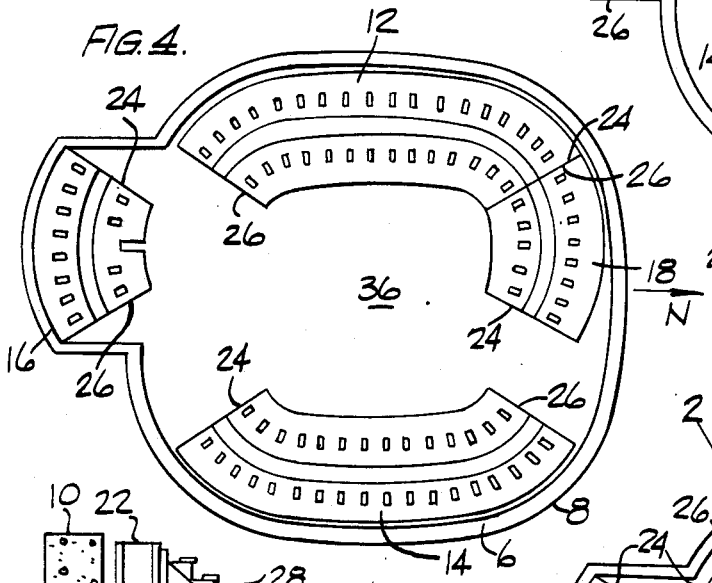
Figure 5:
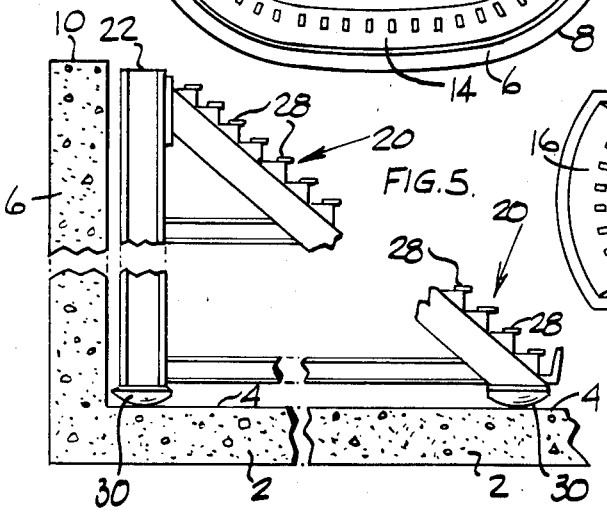
FIG. 5 is a schematic illustration in cross-section of the general nature of each of the sections of stands.

In FIG. 4, the sections 12, 14, 16 and 18 of stands have been positioned relative to each other so as to have a relatively large surface area 36 viewable from the seating means 28 thereof. Any desired surface contour could be provided for the surface area 36. The arrangement can be used for civic affairs, soccer and other activities requiring a large surface area. Also, if domed, it can be used as an exhibition hall, a convention center or other similar purposes.

Figure 6:
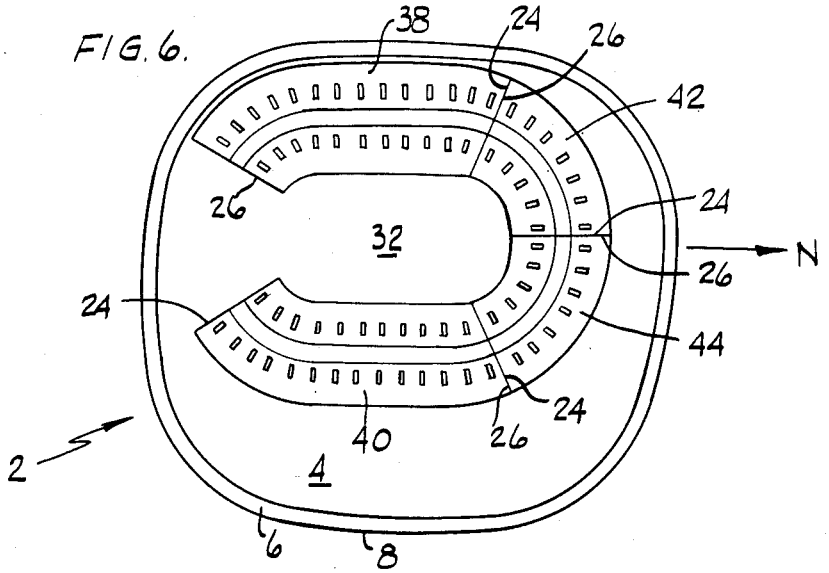
FIGS. 6–8 are top plan views of schematic illustrations of another modification of the invention and illustrating the sections of stands in different locations.
Figure 7:
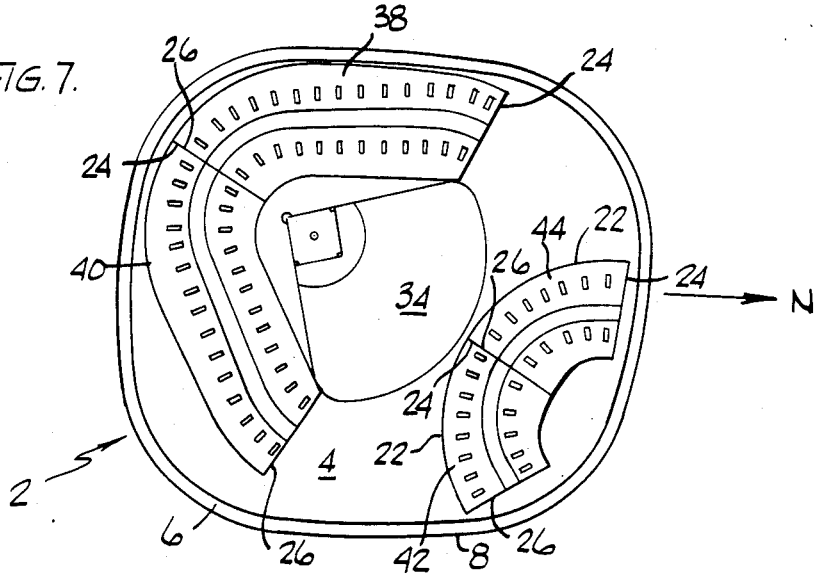
Figure 8:
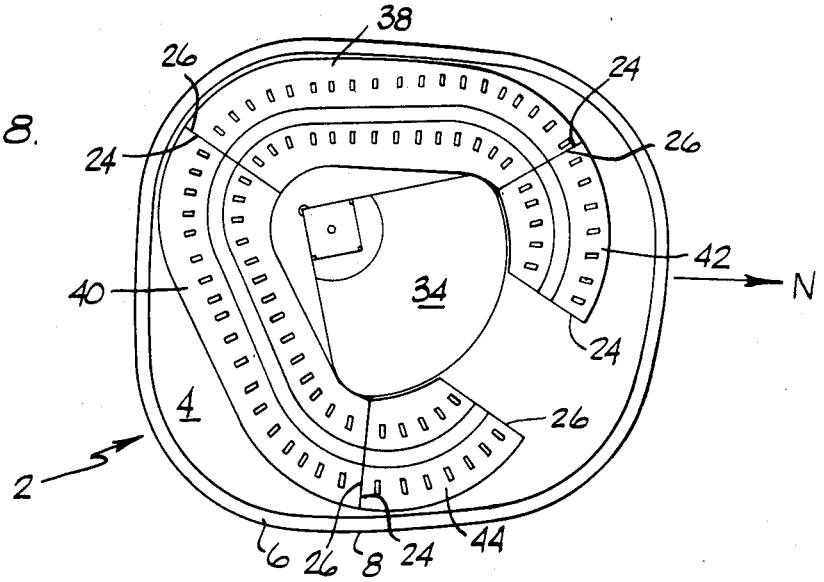

In FIG. 6–8, there is illustrated an arrangement that differs to some degree from that illustrated in FIGS. 1–4. Each of the sections 38, 40, 42 and 44 of stands has an overall construction similar to the sections 12, 14, 16 and 18 of stands. The section 38 of stands is similar to the section 12 of stands in that it is mounted in a relatively fixed position and has the facilities normally associated with a stadium. In the arrangement illustrated in FIG. 6, the sections 38, 40, 42 and 44 of stands have been positioned relative to each other to provide desired seating for a football stadium. As in FIG. 1, the seating means 28 of the sections 38, 40, 42 and 44 of stands are as close as possible to the football field 32. The relative sizes of the sections 38, 40, 42 and 44 of stands differ from the sections 12, 14, 16 and 18 of stands. The seating means 28 of the sections 38 and 40 are each designed to accommodate about twenty thousand spectators. The seating means 28 of the sections 42 and 44 are each designed to accommodate about fifteen thousand spectators. Therefore, when the sections 38, 40, 42 and 44 of stands are arranged as for use as a football stadium, they have a seating capacity for about seventy thousand spectators.

In FIG. 7, the sections 38, 40 and 42 and 44 of stands have been positioned relative to each other to provide desired seating for a baseball stadium. The section 40 of stands has been moved over the generally horizontal surface 4 until the side portion 24 thereof is adjacent to the side portion 26 of the section 38 of stands. The sections 42 and 44 of stands have been moved over the generally horizontal surface 4 and rotated so that the back portions 22 thereof are facing the seating means 28 of the sections 38 and 40 of stands. As described above in relation to FIGS. 2 and 3, the back portions 22 of the sections 42 and 44 of stands may be provided with structures capable of providing information for the spectators in the seating means 28 of the sections 38 and 40 of stands. In the arrangement illustrated in FIG. 7, the seating means 28 of the sections 38 and 40 of stands is as close as possible to the baseball field 34. The sections 38 and 40 of stands, as described above, have a total seating capacity for about forty thousand spectators. If a greater crowd is anticipated, the sections 42 and 44 may be moved and rotated into the arrangement illustrated in FIG. 8 so as to have a seating capacity for about seventy thousand spectators.

Figure 9:
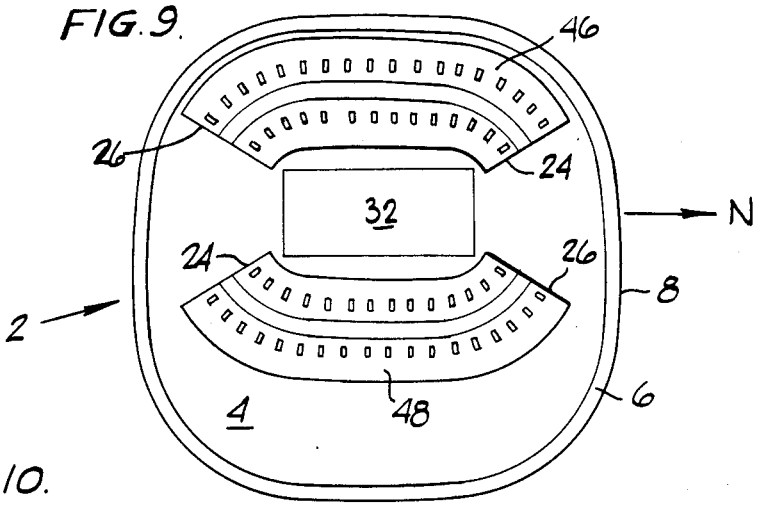
FIG. 9 is a top plan view of a schematic illustration of another embodiment of the invention.

In FIG. 9, there is illustrated a modification of the invention utilizing two sections 46 and 48 of stands. In FIG. 9, the sections 46 and 48 have been positioned relative to each other to provide desired seating for a football stadium. The sections 46 and 48 are separate and spaced apart. The section 46 of stands is similar to the sections 12 and 38 of stands in that it is mounted in a relatively fixed position and has the facilities normally associated with a stadium. When it is desired to convert to a baseball stadium, the section 48 of stands is moved over the generally horizontal surface 4 until the side portion 24 thereof is adjacent to the side portion 26 of the section 46 of stands. The seating means 28 of each of the sections 46 and 48 of stands are designed to accommodate about twenty-five thousand spectators. Therefore, the sections 46 and 48 have a seating capacity of about fifty thousand spectators for either football or baseball.

In the preferred embodiments of the invention, the sections of stands, when arranged to define a football stadium, are positioned relative to each other so that the football field 32 runs generally in a north-south direction as indicated by the arrow N. Also, when the sections of stands are positioned relative to each other to define a baseball stadium, the line passing through home plate and second base of the baseball field 34, extends generally in a southwest to northeast direction. These locations are preferred by all so that the sun is in the preferred location relative to the playing surface. If a dome is provided for the stadium, the relative location of the sections of stands may be as desired.

Figure 10:
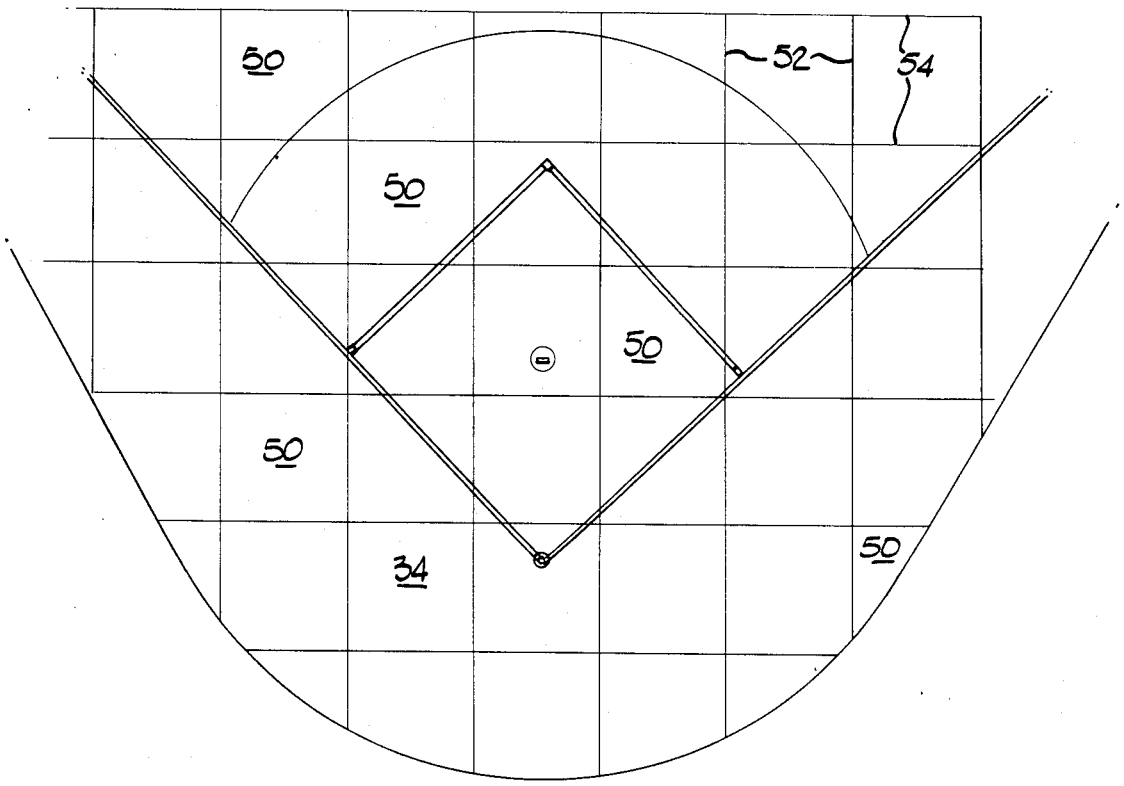
FIG. 10 is a top plan view illustrating a ball field divided into segments.
Figure 11:
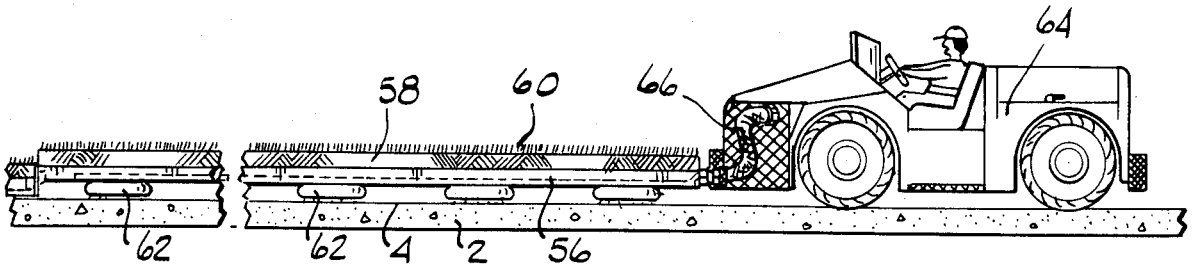
FIG. 11 is a schematic illlustration of the positioning of a portion of a playing surface.

In FIGS. 10 and 11, there is illustrated a system for providing the desired surface contour over the generally horizontal surface 4. The base ball field 34 is divided into a plurality of segments 50 by the intersecting lines 52 and 54. Over each of the segments 50 there is positioned a three-dimensional object having a surface contour corresponding to that required for that portion of the baseball field 34. Each of the three-dimensional objects comprises a support 56, such as a large shallow pan, in which dirt 58, sod 60 or other material is positioned. Each of the supports 56 is provided with means, such as air cushions 62, so as to suspend the support 56 in the atmosphere. A suitable means, such as the tractor 64 having pneumatic means 66 to provide air to the air cushions 62, is used to move the support 56 to a position over its corresponding segment 50 and deposit the support 56 on the segment 50. The segments 50 and the supports 56 can have any desired cross-sectional configuration. In the embodiment illustrated in FIG. 10, the predominant cross-sectional configuration is a square having side edges having a linear extent of about twenty feet. When all of the supports 56 have been positioned over their correspondingly shaped segments 50, the surface contour of the baseball field 34 will have been provided over the generally horizontal surface 4 of the permanent, fixed, rigid supporting base 2. A similar system can be used to provide the surface contour of a football field 32 over the generally horizontal surface 4 of the permanent, fixed, rigid supporting base 2.

It is contemplated that the inventive concepts herein described may be variously otherwise embodied and it is intended that the appended claims be construed to include alternative embodiments of the invention except insofar as limited by the prior art.

What is claimed is:

1. A method for providing different shapes and seating capacities for a stadium complex comprising:

providing at least four separate sections of stands, each of said sections having at least a front portion, a back portion, two side portions, a top portion and a bottom portion;

providing each of said front portions of said sections of stands with means for seating a plurality of spectators, said seating means extending from a location adjacent to said bottom portion to a location adjacent to said top portion;

locating said sections of stands so that a first shaped surface area is viewable from said seating means thereof;

providing a permanent, fixed, rigid supporting base having a generally horizontal surface for supporting said sections of stands, said supporting base having a shaped, predetermined perimeter;

providing means on a plurality of said sections of stands so that said plurality of sections of stands are movable over said supporting base in a generally horizontal plane;

causing relative movement between a first section and a second section of said sections of stands to form at least a partial enclosure around a second shaped surface area viewable from said seating means of said first and second sections;

moving a third section of said sections of stands to an area on said supporting base, said area being adjacent to but spaced from said first and second sections of stands but not viewable from said seating means of said first and second sections of stands forming said partial enclosure; and maintaining said at least four sections of stands within said perimeter of said supporting base at all times.

2. A method as in claim 1 and further comprising:

securing said first section of stands at a fixed location on said supporting base.

3. A method as in claim 1 and further comprising:

forming said first shaped surface area as a football field; and forming said second shaped surface area as a baseball field.

4. A method as in claim 3 and further comprising:

locating said football field so that its greater lengths extends generally in a north-south direction; and locating said baseball field so that a line passing through home plate and second base extends generally in a southwest-northeast direction.

5. A method as in claim 1 and further comprising:

positioning said first and second sections of stands forming said partial enclosure so that side portions thereof are adjacent to each other so as to form substantially one unit of stands having an open end portion.

6. A method as in claim 5 and further comprising:

moving said fourth section of stands to a location so that the center of said fourth section of stands is spaced substantially equidistantly from each of the sides of said first and second sections forming said open end portion and said seating means thereof are viewable from said seating means of said first and second section of stands forming said partial enclosure.

7. A method as in claim 5 and further comprising:

moving a fourth section of said sections of stands so that said seating means thereof are not viewable from said seating means of said first and second sections of stands forming said partial enclosure.

8. A method as in claim 7 and further comprising:

providing said said back portion of said fourth section of stands with a surface facing and viewable from said first and second sections of stands forming said partial enclosure; and locating said fourth of section of stands so that the center of said surface is spaced substantially equidistantly from each of the sides of said first and second sections forming said open end portion.

9. A method as in claim 8 and further comprising:

providing said surface of said fourth section of stands with structures providing information to said spectators.

10. A method for providing different shapes and seating capacities for a stadium complex comprising:

providing at least three sections of stands, each of said sections having at least a front portion, a back portion, two side portions, a top portion and a bottom portion;

providing each of said front portions of said sections of stands with means for seating a plurality of spectators, said seating means extending from a location adjacent to said bottom portion to a location adjacent to said top portion;

locating said sections of stands so that a first shaped surface area is viewable from said seating means thereof;

providing a permanent, fixed, rigid supporting base having a generally horizontal surface for supporting said sections of stands, said supporting base having a shaped, predetermined perimeter;

providing means on a plurality of said plurality of sections of stands so that said plurality of sections of stands are movable over said supporting base in a generally horizontal plane;

causing relative movement between a first section and a second section of said sections of stands to form at least a partial enclosure around a second shaped surface area viewable from said seating means of said first and second sections;

moving a third section of said sections of stands so that said seating means thereof are not viewable from said seating means of said first and second sections of stands forming said partial enclosure; and maintaining said at least three sections of stands within said perimeter of said supporting base at all times.

11. A method as in claim 10 and further comprising:

moving said third section of stands to a location so that the center of said third section of stands is spaced substantially equidistantly from each of the sides of said first and second sections forming said open end portion and said seating means of said third section are viewable from said seating means of said first and second sections of stands forming said partial enclosure.

12. A method as in claim 10 and further comprising:

forming said first shaped surface area as a football field; and forming said second shaped surface area as a baseball field.

13. A method as in claim 12 and further comprising:

locating said football field so that its greater length extends generally in a north-south direction; and.

locating said baseball field so that a line passing through home plate and second base extends generally in a southwest-northeast direction.

14. A method as in claim 10 and further comprising:

positioning said plurality of sections of stands forming said partial enclosure so that side portions thereof are adjacent to each other so as to form substantially one unit of stands having an open end portion.

15. A method as in claim 14 and further comprising:

providing said third section of stands with a surface facing and viewable from said first and second sections of stands forming said partial enclosure;

locating said third section of stands so that the center of said surface is spaced substantially equidistantly from each of the sides of said first and second sections forming said open end portion.

16. A method as in claim 15 and further comprising:

providing said surface of said at least one of said plurality of sections of stands with structures providing information to said spectators.

17. A method for providing different shapes for a stadium complex comprising:

providing a plurality of sections of stands, each of said sections having at least a front portion, a back portion, two side portions, a top portion and a bottom portion;

providing each of said front portions of said sections of stands with means for seating a plurality of spectators, said seating means extending from a location adjacent to said bottom portion to a location adjacent to said top portion;

said seating means comprising all of said seating means for said stadium;

locating said sections of stands so that each section is spaced from the other and a first shaped surface area is viewable from said seating means thereof;

providing a permanent, fixed, rigid supporting base having a generally horizontal surface for supporting said sections of stands, said supporting surface having a shaped, predetermined perimeter;

providing means on at least one of said sections of stands so that said at least one of said sections of stands is movable over said supporting base generally in a horizontal plane; and moving said at least one of said sections of stands to form a partial enclosure around a second shaped surface area; and maintaining said plurality of stands within said perimeter of said supporting base at all times.

18. A method as in claim 17 and further comprising:

positioning said plurality of sections of stands forming said partial enclosure so that side portions thereof are adjacent to each other so as to form substantially one unit of stands having an open end portion.

19. A method for providing a desired surface contour for a playing field of a stadium complex comprising:

providing a plurality of sections of stands;

locating said sections of stands to define a shaped surface area of a playing field therebetween;

dividing said shaped surface area into a plurality of segments, each of said segments having a predetermined shape;

forming a plurality of supports, each having a shape corresponding to one of said segments;

forming on each of said supports a three-dimensional object having a portion of said desired surface contour thereon; and placing each of said supports over its corresponding segment to form said desired surface contour for said playing field.

20. A method as in claim 19 wherein said three-dimensional object comprises:

sod.

21. A method as in claim 20 and further comprising:

providing each of said supports with means to suspend each of said supports in the atmosphere so that each of said supports may be readily moved to different locations in a generally horizontal plane.

22. A method as in claim 21 and further comprising:

forming each of said supports to have the same horizontal cross-sectional configuration.

23. Apparatus for providing different shapes and seating capacities for a stadium complex comprising:

at least three separate sections of stands, each of said sections having at least a front portion, a back portion, two side portions, a top portion and a bottom portion;

each of said front portions of said sections of stands having seating means for a plurality of spectators, said seating means extending from a location adjacent to said bottom portion to a location adjacent to said top portion;

said sections of stands being located relative to each other so that a first shaped surface area is viewable from said seating means;

a permanent, fixed, rigid supporting base having a generally horizontal surface for supporting said sections of stands, said supporting surface having a shaped, predetermined perimeter;

means for providing relative movement between a first section and a second section of said sections of stands over said supporting base in a generally horizontal plane so that the relative location thereof has been changed;

said first and second sections of stands after said relative movement defining a second shaped surface area that is viewable from said seating means of said first and second sections of stands;

means for moving a third section of said sections of stands to a location at which said back portion thereof is viewable from said seating means of said first and second sections of stands but said seating means of said third sections of stands are not viewable from said seating means of said first and second sections of stands defining said second shaped surface area; and said at least three sections of stands being located at all times within said perimeter of said supporting base.

24. Apparatus as in claim 23 and further comprising:

at least a fourth separate section of stands having at least a front portion, a back portion and two side portions;

said front portion having seating means for a plurality of spectators;

means for moving said fourth section of stands to a location at which said fourth section of stands is not viewable from said seating means of said first and second sections of stands; and said fourth section of stands being located at all times within said perimeter of said supporting base.

25. Apparatus as in claim 23 and further comprising:

said first and second sections of stands defining said second shaped surface area being located so that side portions thereof are adjacent to each other and forming substantially one unit of stands having an open end portion.

26. Apparatus as in claim 25 and further comprising:

a surface on said back portion of said third section of stands which is viewable from said seating means of said first and second sections of stands defining said second shaped surface area; and said surface being located so that the center thereof is spaced substantially equidistantly from each of the sides of said first and second sections forming said open end portion.

27. Apparatus as in claim 26 and further comprising:

means associated with said surface for providing information for said spectators.

* * * * *